United States Patent [19]

Grant

[11] Patent Number: 4,574,538

[45] Date of Patent: Mar. 11, 1986

[54] METHOD AND APPARATUS FOR MOUNTING ACOUSTIC FABRIC

[76] Inventor: Michael J. Grant, Mt. Angel, Oreg.

[21] Appl. No.: 712,358

[22] Filed: Mar. 15, 1985

[51] Int. Cl.[4] ..... E04B 1/82

[52] U.S. Cl. ..... 52/144; 52/222; 52/404; 160/378

[58] Field of Search ..... 52/144, 145, 222, 404; 160/378; 38/102.8; 181/290

[56] References Cited

U.S. PATENT DOCUMENTS

| | | | |
|---|---|---|---|
| 2,888,070 | 5/1959 | Smith | 160/378 X |
| 3,726,056 | 4/1973 | Harris et al. | 52/144 X |
| 3,745,729 | 7/1973 | Vaughn et al. | 52/222 |
| 3,748,799 | 7/1973 | Tough et al. | 52/144 |
| 3,848,380 | 11/1974 | Assael | 52/222 |
| 3,914,887 | 10/1975 | Newman | 160/378 X |
| 3,934,382 | 1/1976 | Gartung | 52/144 |
| 3,971,867 | 7/1976 | Randall | 52/145 X |
| 4,210,191 | 7/1980 | Li | 160/378 X |
| 4,255,912 | 3/1981 | Kovacs | 52/222 X |
| 4,404,962 | 9/1983 | Zinn et al. | 52/222 X |

FOREIGN PATENT DOCUMENTS

| | | | |
|---|---|---|---|
| 2509272 | 9/1976 | Fed. Rep. of Germany | 52/222 |
| 2916814 | 11/1980 | Fed. Rep. of Germany | 52/222 |
| 601592 | 7/1978 | Switzerland | 52/222 |

*Primary Examiner*—J. Karl Bell

*Attorney, Agent, or Firm*—Klarquist, Sparkman, Campbell, Leigh & Whinston

[57] ABSTRACT

An acoustic fabric-mounting system includes a fabric stretched across a wooden frame of an acoustic panel. Some frame members are fixed to a wall, while other frame members are connected to one or more brackets which allow them to move relative to the fixed members along the wall. A tensioning bracket mounted beneath the panel exerts an expansion force against the movable frame member, tending to move it translationally apart from the fixed frame member, so that the fabric is stretched taut. The tensioning bracket is spring-loaded and adjustable.

13 Claims, 14 Drawing Figures

FIG. 5a
FIG. 5
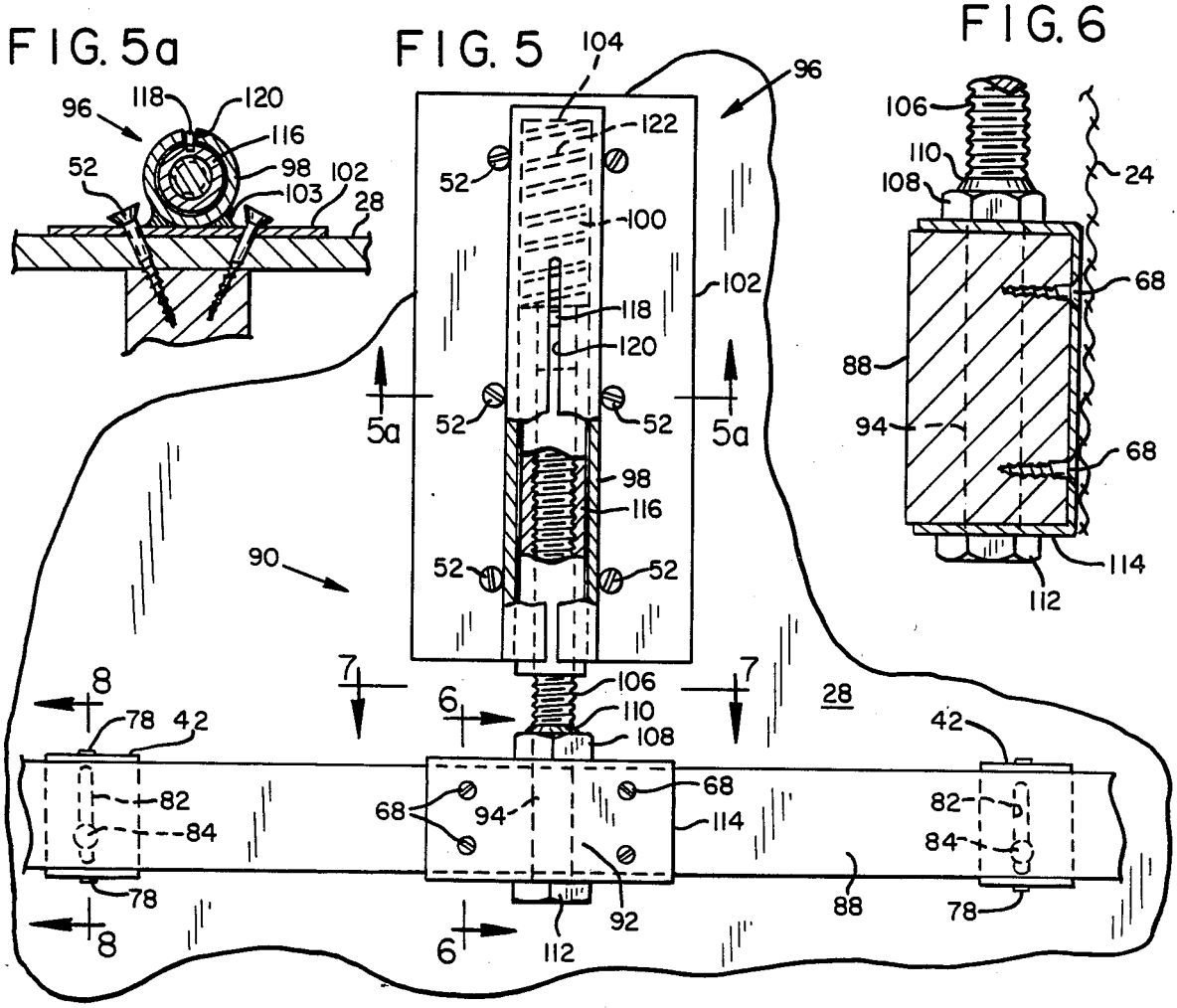
FIG. 6
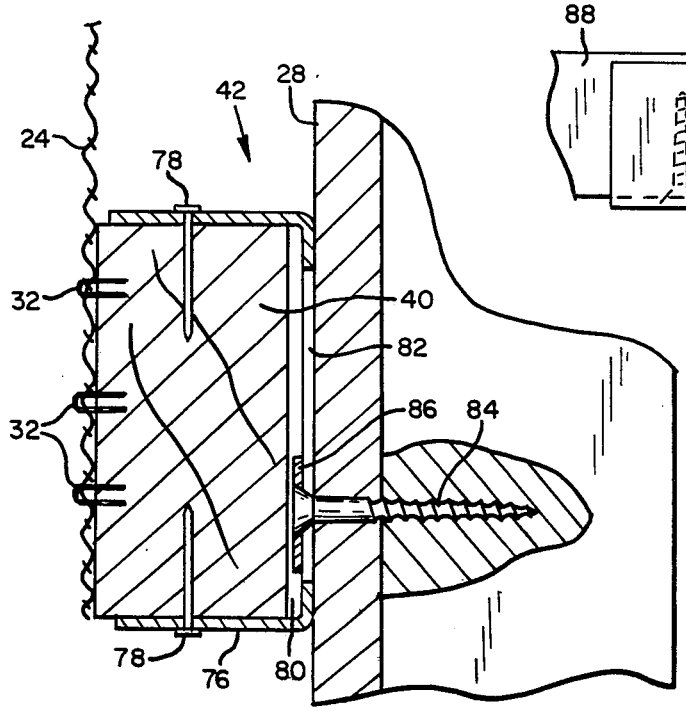
FIG. 8
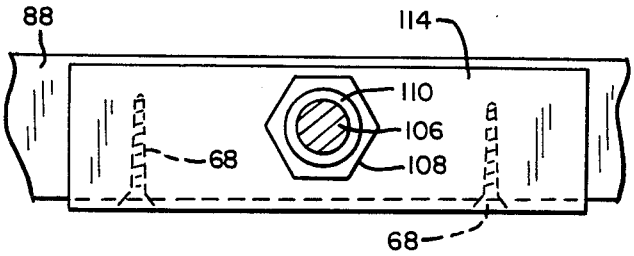
FIG. 7

FIG. 9
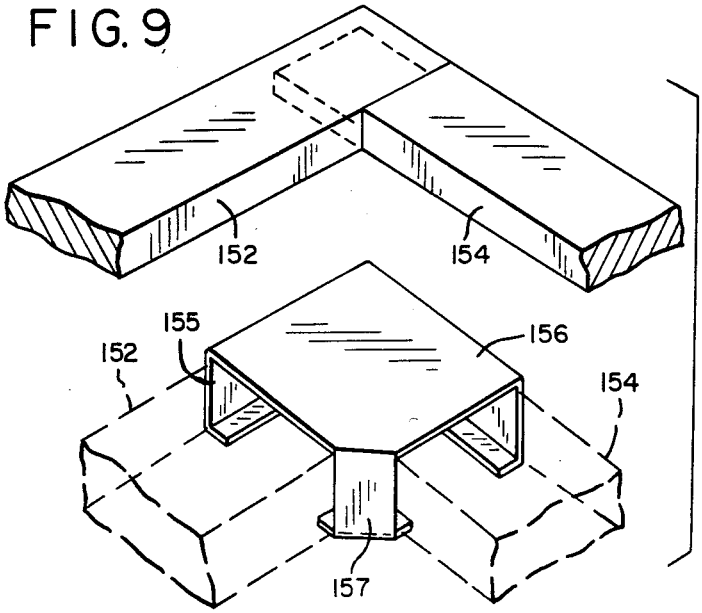
FIG. 13
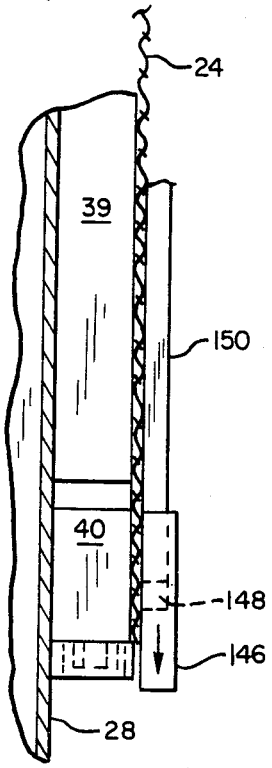
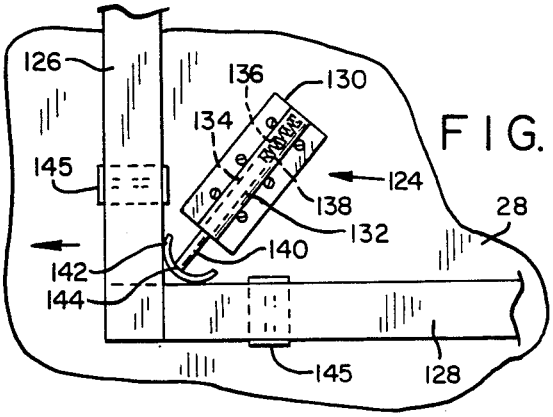
FIG. 10
FIG. 11
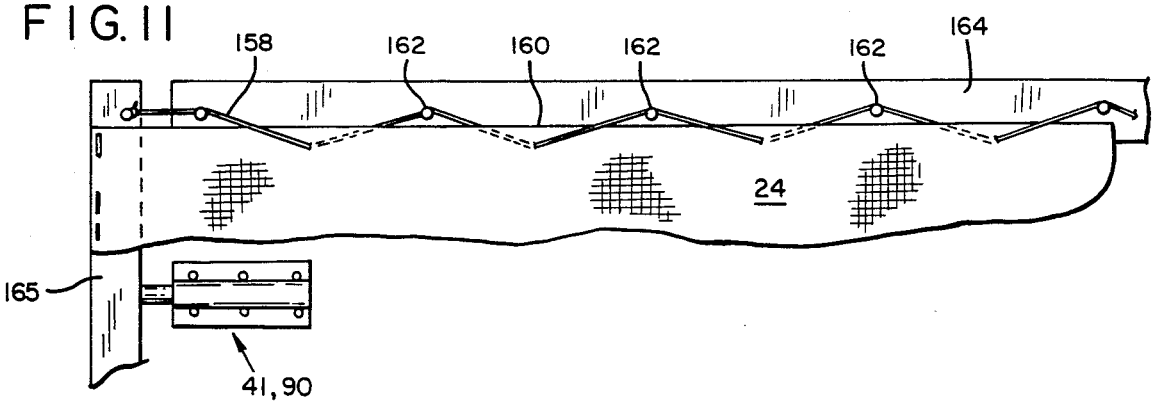
FIG. 12
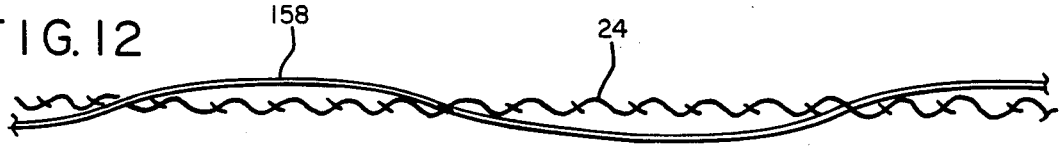

METHOD AND APPARATUS FOR MOUNTING ACOUSTIC FABRIC

BACKGROUND OF THE INVENTION

Churches and other meeting halls often use acoustic panels to improve the sound-absorbing characteristics of wall surfaces. These panels typically include rigid insulation panels mounted within a wood frame and covered by a sisal fabric.

The sisal fabric covering used with such panels is mounted by attaching one edge of the fabric to a member of the frame and then manually stretching the fabric taut over the insulation panels. The other edge of the fabric is then attached to the opposite member of the frame.

After a period of time, the covering fabric stretches and begins to sag. Unattractive folds of fabric appear on the acoustic panels and detract from the beauty of the church. To eliminate this sagging the fabric must be removed from the frame and remounted in the same manually-stretched fashion. Since these acoustic panels are frequently mounted at inaccessible heights on the walls of the church, the correction of this fabric sagging problem often requires the erection of scaffolding, with considerable labor and expense.

Sagging acoustic panel fabric may also be caused by short term changes in the relative humidity. Such temporary sagging is generally tolerated by churches, despite the poor appearance of the acoustic panels, because of the costs of repair and likelihood of repeated sagging.

It has been proposed that the sagging problem may be prevented by bonding a stiff fibrous "tectum" board under the sisal fabric. This backing retards the sagging of the fabric, but also reduces the acoustic qualities of the panels by greater than 90 percent.

Accordingly, a need remains for a better system of mounting acoustic panel fabrics.

SUMMARY OF THE INVENTION

One object of the present invention is to eliminate sagging of acoustic panel fabrics.

A further object of the present invention is to reduce the sagging of acoustic panel fabrics without impairing the acoustic qualities of the underlying panel.

Yet another object of the present invention is to minimize the labor and expense involved in maintaining acoustic panels.

The present invention comprises a method and apparatus for adjusting the frame on which acoustic panel covering fabric is mounted in order to eliminate sagging of the fabric.

According to the invention, the frame members of an acoustic panel are not all rigidly connected together. Some members are fixed to the wall, while other members are connected to special brackets which allow them to move relative to the fixed members along the wall. A force is exerted against the movable member, tending to move the movable member translationally apart from a fixed member, thereby stretching the fabric taut. This expansion force is exerted against the movable member by one or more tensioning means each pushing against an anchor secured to the wall beneath the panel. An anchor is here understood to include any object, such as a block, bracket, plate, member, etc., which when mounted to a wall can be pushed against by a member, through the tensioning means, to develop a tensioning force in the fabric. The terms "horizontal" and "vertical" are used herein only to define the relative orientation of the elements of the frame, without limiting utility of the invention to any particular orientation of the panel as a whole.

In one embodiment the tensioning means can be a shaft which abuts the movable member and which yieldably interengages a spring mounted in a hole in the anchor member. In another embodiment the tensioning means can be a bolt which is rotatably fixed in the anchor member or in the movable member and which engages threads in the other member.

Preferably, the tensioning means comprises a bolt, rotatably secured in a hole though the movable member, which extends into and engages an internally-threaded cylinder keyed to slide linearly within a hole in the anchor, which cylinder yieldably interengages a spring in the anchor to effect an adjustable tensioning force against the movable member.

The foregoing and additional objects, features and advantages of the present invention will be more readily apparent from the following detailed description of preferred embodiments thereof which proceeds with reference to the accompanying drawings.

BRIEF DESCRIPTION OF THE DRAWINGS

FIG. 5 is a partial front view of a second acoustic panel with the fabric covering removed to show a second preferred form of mounting apparatus in accordance with the present invention;

FIG. 5*a* is a sectional view along line 5—5 of FIG. 5;

FIG. 6 is a sectional view along line 6—6 of FIG. 5;

FIG. 7 is a sectional view along line 7—7 of FIG. 5;

FIG. 8 is a cross sectional view along line 8—8 of FIG. 5 showing a sliding bracket in accordance with the present invention;

FIG. 9 is a perspective view of an expandable corner joint between two trim pieces and a corresponding covering bracket in accordance with the present invention;

FIG. 10 is a front view of a portion of an acoustic panel frame with an alternative positioning bracket arrangement in accordance with the present invention designed to stretch the frame in two dimensions;

FIG. 11 is a front view showing a laced fabric support system used in accordance with the present invention on horizontally expanding frames;

FIG. 12 is a detail of the lacing arrangement of FIG. 1; and

FIG. 13 is a side view of a frame employing an expandable trim system in accordance with the present invention.

DETAILED DESCRIPTION OF PREFERRED EMBODIMENTS

Prior Art

Figure 1:
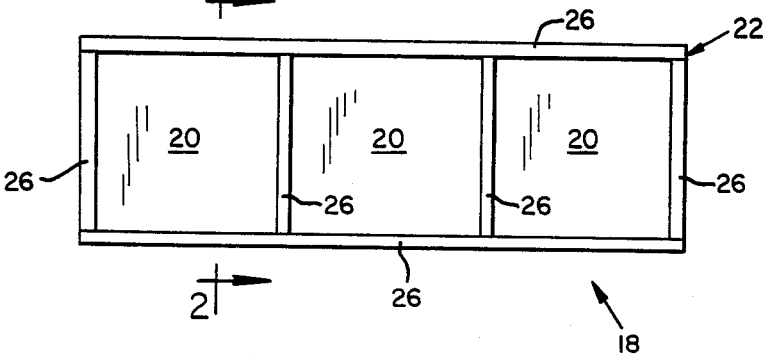
FIG. 1 Prior Art
FIG. 1 is a front view of a a prior art acoustic panel with the fabric covering and trim pieces removed.
Figure 2:
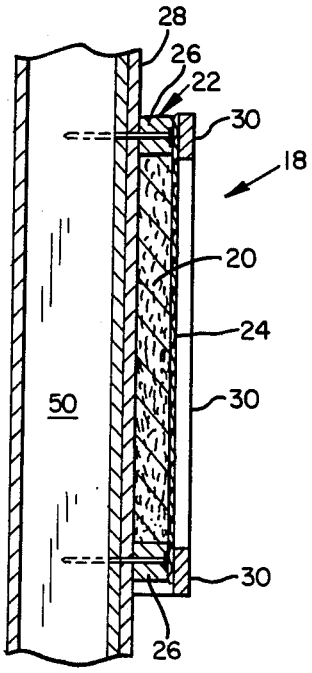
FIG. 2 Prior Art
FIG. 2 is a sectional view taken along line 2—2 of FIG. 1 showing the underlying wall and the fabric covering mounted in place.

As shown in FIGS. 1 and 2, an acoustic panel 18 generally comprises rigid insulation panels 20 mounted within a rectangular frame 22 and covered by a sisal fabric 24. Staples join the sisal fabric to the frame all around the perimeter of the frame. Frame 22 comprises vertical and horizontal frame members 26, typically 2×3 inch lumber, rigidly interconnected at their ends. The panel is affixed to a wall 28 by nails or screws through the frame members. Decorative wood trim pieces 30 (FIG. 2) are typically mounted around the perimeter of the panel over the fabric to conceal the wood frame 22 and staples.

Whenever it becomes necessary to restretch the fabric 24 covering the acoustic panel 18, the fabric must be disconnected from the frame. This necessitates erecting scaffolding, removing the decorative trim pieces 30 fixed to the frame, and removing a multitude of staples. The fabric 24 is then restretched and restapled to the frame 22, and the trim pieces 30 are reattached to the frame.

First Embodiment

Figure 3:
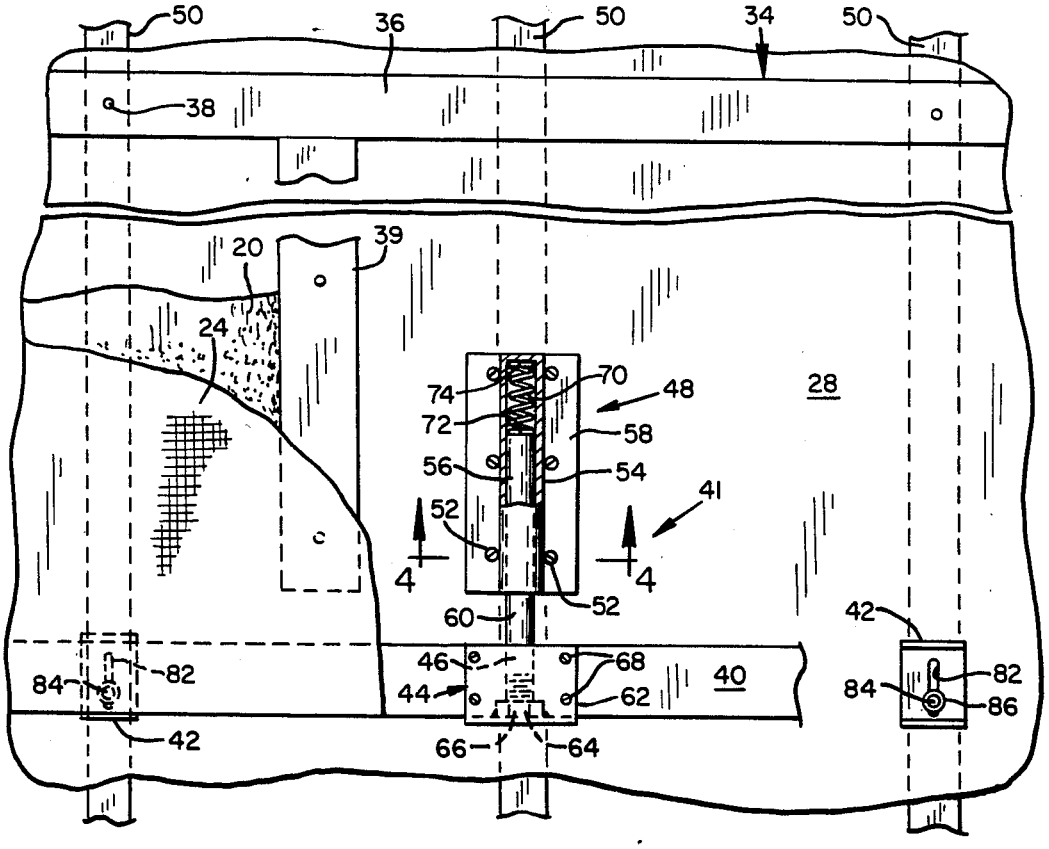
FIG. 3 is a partial front view of an acoustic panel with the fabric cut away to show one form of mounting apparatus in accordance with the present invention.

As shown in FIG. 3, in a first embodiment of the present invention, the frame 34 comprises a first elongated horizontal frame member 36 affixed to the wall 28 by means such as nails, screws or lag bolts 38, and a second such member 40 spaced below first member 36. Member 40 is connected to the wall 28 using sliding brackets 42 which allow the second member to move relative to the first along the wall. A single fabric sheet 24 extends between members 36 and 40 and has its opposite margins secured to the members by any suitable means, such as staples. Vertical frame members 39 are provided at the ends of the panel and at suitable intervals between the ends to support the rigid insulation material 20. The vertical members can be affixed to the wall or the first horizontal member, or to both, but not to the second horizontal member, which must remain free to move vertically along the wall. The fabric is not connected to the vertical members.

Figure 4:
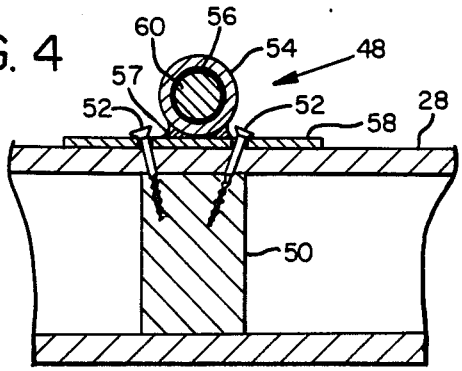
FIG. 4 is a sectional view along line 4—4 of FIG. 3.

With reference to FIGS. 3 and 4, a translational force is exerted on member 40 by a tensioning apparatus 41, generally comprising an anchor 58 affixed to wall 28, an expansion means 48 including a shaft 60 having one end engaging the anchor, and a means 44 for securing an opposite end of the expansion shaft to member 40. Means 44 includes a first hole 46 which extends through member 40 for receiving the above-mentioned opposite end of the expansion means shaft. Hole 46 is ordinarily oriented with its axis parallel to the plane of the wall and perpendicular to the principal axis of elongated member 40. The expansion means 48 is likewise oriented to exert the translational force normal to member 40.

The anchor of the present embodiment is a mounting bracket 58 affixed to wall 28 and to the underlying building support member or stud 50 by means such as nails or screws 52. Mounted on this bracket is a cylindrical sleeve 54 with a bottom closure defining a second hole 56 of a predetermined depth. Anchor 58 can alternatively be mounted on or formed in an end of a member, such as vertical frame member 39, which is affixed to the wall 28. Bracket 58 is preferably made of sheet metal and sleeve 54 is a 1-inch steel pipe welded by weld 57 to bracket 58.

Expansion means 48 is positioned so that hole 56 is aligned with the first hole 46 in elongated member 40. Extending through first hole 46 and into the second hole 56 is a bolt 60 forming the shaft of the expansion means. Bolt 60 is retained in first hole 46 by means 44 which includes a reinforcing bracket 62 holding the head 64 of bolt 60 in a countersunk hole 66 within member 40. Reinforcing bracket 62 is a sheet metal plate bent to a U-shape to conform to member 40 and is attached thereto by screws or nails 68.

The expansion means also includes coil spring 70 positioned compressibly between the other end 72 of bolt 60 and the bottom 74 of second hold 56, so as to exert a translational force through bolt 60 against member 40. Bottom 74 is a sheet metal plate welded to the end of pipe 54 defining hole 56.

In assembling the frame shown in FIG. 3, member 40 is forced by external means to a vertical position in which spring 70 is compressed. Fabric 24 is then stretched across the frame and attached to it by fastening means 32 such as staples (FIG. 8). Removing the external vertical force from member 40 allows tensioning bracket 48 to automatically regulate the tension in fabric 24 by appropriately positioning member 40.

Provision can be made for "pinning" tensioning bracket 48 in the fully-compressed position to facilitate initial erection of the panel. This is accomplished by providing a small hole (not shown) through both the bolt 60 and the pipe 54 when the spring is fully compressed. The pin prevents the spring from expanding during installation. Removal of the pin enables normal operation.

In an alternative fabric support system, a threaded bolt hole is provided in the bottom of bracket 62 and the bolt is threaded through these threads and into the hole in the tensioning bracket. The end of the bolt abuts the bottom of the hole in the tensioning bracket. The head of the bolt is exposed so that it can be rotated to move the bolt forward or away from the tensioning bracket, to vary the distance between the tensioning bracket and the movable member.

This alternative system can be used with or without a spring to yieldably interengage the bolt and the anchor. Using the spring enables adjusting the distance between the tensioning bracket and the movable member, and consequently the fabric tension, automatically. The compression of the spring can be increased or decreased as desired by positioning the bolt further in or out of the hole in the tensioning bracket, respectively.

In these fabric support systems having a bolt threaded through the movable frame member, the bolt may at times protrude beneath the frame, such protrusion is not always concealed by the decorative trim pieces and may be undesirable in certain applications, in which case the second embodiment described hereinafter is preferred.

Sliding Bracket

Sliding bracket 42, used to movably attach member 40 to wall 28, is shown in FIGS. 3 and 8. The bracket includes a sheet metal U-shaped member 76, best seen in FIG. 8, bent to conform to the width of member 40 and attached to member 40 by nails or screws 78. A gap 80 is preserved between the bottom of U-shaped member 76 and member 40. Running along the length of the bottom of U-shaped member 76, perpendicular to the major axis of member 40, is a narrow slot 82. A screw 84 connects sliding bracket 42 to wall 28. The screw passes through a washer 86, slot 82, and wall 28 into building support member 50. Member 40 is thus secured against the wall, but is able to slide relative to it for a distance equal to the length of slot 82. Member 42 counteracts any torsion exerted on member 40 by the stretched fabric and resists any tendency of the fabric to lift portions of members 140 off the wall.

Second Embodiment

In some applications it is desirable to vary the force exerted by the tensioning bracket against the movable member without having a bolt extend visibly beneath the frame. In such situations, the fabric support system shown in FIGS. 5, 5*a*, 6 and 7 can be used.

This embodiment again includes a first elongated frame member (not shown) affixed to the wall, and a second such member 88 spaced below the first member. Member 88 is connected to wall 28 using sliding brackets 42 which allow the second member to move relative to the first along the wall. A single fabric sheet extends between the horizontal frame members and has its opposite margins secured to the members by any suitable means, such as staples. Vertical frame members (not shown) can be provided at the ends of the panel and at suitable intervals between the ends to support the rigid insulation material. The vertical members can be affixed to the wall or the first horizontal member, or to both, but not to the second horizontal member 88, which must remain free to move vertically along the wall. The fabric is not connected to the vertical members.

With reference to FIGS. 5, 5*a*, 6 and 7, a translational force is exerted on member 88 by a tensioning apparatus 90, generally comprising an anchor 102 affixed to wall 28, and expansion means 96 including a bolt 106 having one end engaging the anchor, and a means for coupling an opposite or head end of the bolt to member 88.

Member 88 includes a first hole 94 which extends through member 88 for receiving the opposite end of the expansion means bolt. Hole 94 is oriented with its axis parallel to the plane of the wall and perpendicular to the principal axis of elongated member 88. The expansion means is likewise oriented to exert the translational force normal to member 88.

The anchor of the present embodiment comprises a mounting bracket 102 affixed to wall 28 by means such as nails or screws 52. Mounted on this bracket is a cylindrical sleeve 98 with a bottom closure 104 defining a second hole 100 of a predetermined depth. Bracket 102 is preferably made of sheet metal and sleeve 98 is a 1-inch steel pipe welded by weld 103 to bracket 102.

Bracket 102 is positioned so that hole 100 is aligned with the first hole 94 and elongated member 88. Extending through first hole 94 and into the second hole 100 is a fully-threaded bolt 106 forming the shaft of the expansion means. Bolt 106 is retained in first hole 94 by nut 108 welded to bolt 106 by weld 110. Head 112 of bolts 106 protrudes out the other side of member 88, so bolt 106 is free to rotate in the hole 94. Reinforcing bracket 114 provides a bearing surface against which nut 108 and bolt head 112 can rotate and is preferably made of a sheet metal plate bent to a U-shape, best seen in FIG. 7, to conform to member 88 and is attached thereto by screws or nails 68.

The expansion means includes a means defining a thread within pipe 98 into which bolt 106 may be threaded. This thread-defining means comprises an internally-threaded tube 116 keyed to slide linearly within pipe 98. As shown in FIGS. 5 and 5*a*, internally-threaded tube 116 includes a key 118 that slides linearly within a slot 120 in the pipe 98. Threaded tube 116 is caused to move in or out of pipe 98 by rotation of bolt 106. Compressed between the end of threaded tube 116 and the bottom 104 of hole 100 is a spring 122 which serves to yieldably interengage tube 116 and the bottom of hole 100.

The tension of the fabric covering the frame can be adjusted by turning head 112 of bolt 106, thereby moving internally-threaded tube 116 on bolt 106. If head 112 is turned clockwise, tube 116 will move away from spring 122, thereby reducing its compression and the tension of the fabric. In assembling the frame using this embodiment, tube 116 is threaded out to decompress the spring by turning bolt head 112 clockwise. Bolt head 112 is then turned counterclockwise to move tube 116 toward spring 122, thereby increasing its compression and accordingly the tension of the fabric.

Two Dimension Expansion Systems

In some applications it may be desirable to expand the frame in two dimensions. This can be accomplished by using two sets of the above-described devices: one set to effect horizontal movement of a frame member, the other to effect horizontal movement of a frame member. Alternatively, a single device such as that shown in FIG. 10 can be used at each corner of the frame.

In FIG. 10 a tensioning bracket 124 exerts forces on two orthogonal frame members 126 and 128 which are not connected to each other. The tensioning bracket 124 comprises an anchor 130, firmly attached to the wall surface 28, to which means 132 defining a hole 134 is mounted. A spring 136 is positioned at the bottom of hole 134 and yieldably interengages the anchor 130 with an end 138 of a shaft 140. A semi-circular bracket 142 is mounted to the other end 144 of shaft 140 and engages frame members 126 and 128. Frame members 126 and 128 are movably coupled to wall surface 28 by slidable brackets 145, similar to brackets 42.

The force exerted by tensioning bracket 124 against frame members 126 and 128 causes them to move apart, thereby maintaining tension in the fabric spread between the members.

Expandable Wood Trim

Decorative wood trim is often placed around the perimeter of conventional acoustic panels to conceal their functional wood frames. A modified form of such trim can also be used with the expandable frames of the present invention.

FIG. 13 shows a horizontal trim element 146 approximately $\frac{3}{4}$ inch thick by 3 inches wide mounted on a vertically-expandable frame member 40. Into it is cut a mortise pocket 148 for slidably receiving an end portion of a vertical trim piece 150, mounted atop an end vertical member 39. As the frame contracts and expands, the end portion of the vertical trim piece 150 slides in and out of pocket 148 and revealed, thereby preserving the finished look of the panels.

FIG. 9 shows an alternative device for the same purpose. Two orthogonal trim pieces 152 and 154 meet at a corner, their ends forming a lap joint but not being fixed together. A corner bracket 156, made of metal and painted or covered with wood grain veneer, is fitted over the junction between the two trim pieces. The sides 155 of corner bracket 156 are made longer than the width of the trim pieces. A diagonal tab 157 retains the trim pieces against sides 155. As the frame expands over time, the trim piece ends move apart, but their junction remains covered by corner bracket 156. The size of the corner bracket 156 determines how much the frame can expand without revealing the trim pieces' junction.

Fabric Connection to Expandable Frames

In the illustrated embodiments staples may be used to connect the fabric to the horizontal members. The fabric, however, must be free to expand in the vertical direction. This precludes connecting the fabric directly to the vertical frame members. Instead, the vertical margins of the fabric are left unconnected and are concealed under the vertical trim pieces.

Likewise, when the frame is designed to expand horizontally, provision must be made to allow the fabric to stretch horizontally. In this case, however, the fabric cannot be left unconnected along the horizontal length in long panel or it will sag downward under the force of gravity. To alleviate this problem the inventor has devised the scheme illustrated in FIGS. 11 and 12 which holds the fabric up without restraining its horizontal movement. A resilient monofilament nylon line 158 is laced along the top horizontal margin 160 of the fabric 24 and is suspended by nails 162 spaced periodically along the top frame member 164. The nails may be spaced 6 inches apart. This lacing arrangement is concealed by the trim pieces.

When the frame is erected, the monofilament line 158 is drawn taut and secured at both ends to the veritcal frame members 165. As the frame expands horizontally, monofilament line 158 stretches. The fabric 24 is tensioned, but is prevented from sagging by the laced coupling to the frame.

Operation

The method of operation is best explained with reference to FIGS. 3 and 8. The frame is provided including two spaced-apart members 36 and 40. Member 36 is mounted on a wall 28. A first margin of flexible sheet 24 is connected to the first member 36. A second margin of sheet 24 is connected to second member 40. An anchor 58 is mounted on the wall 28 at a position in between members 36 of 40. Expansion means 48 are provided for interengaging anchor 58 and second member 40 for translationally positioning second member 40 relative to first member 36. This expansion means is operated to apply a force directed against second member 40 away from first member 36 so as to tension fabric 24.

The tension of fabric 24 pulling on these members along the plane of their front surfaces produces a torsion in frame members 36 and 40, the back surfaces of which are connected to the wall.

Top frame member 36 may is prevented from rotating by fixing it securely to the wall. Movable member 40 is prevented from rotating at the tensioning bracket by using a rigid shaft or bolt received in the first and second holes. Between the tensioning brackets, rotation of member 40 is minimized by positioning the screws 84, which hold brackets 42 and thereby member 36 to the wall, in the ends of slots 82 farthest away from the center of the panel.

Having described and illustrated the principles of my invention and preferred embodiments, it should be apparent to those skilled in the art that the invention may be modified in arrangement and detail without departing from such principles.

I claim all modifications coming within the scope and spirit of the following claims:

1. An acoustic fabric-mounting system comprising:

a first elongated member and means for affixing said member to a wall;

a second elongated member spaced apart from said first member;

a fabric sheet connected to and extending between the first and second members;

means defining a first hole extending through the second member parallel to the wall;

a third member, including means defining a second hole of a predetermined depth aligned with the first hole, and means for mounting the third member to the wall;

a bolt extending through the first hole into the second hole;

means for retaining the bolt in the first hole;

means for interengaging the bolt and said means defining the second hole;

means defining a thread within one of the first or second holes for threading the bolt in and out, thereby altering a spacing between the first and second members so as to stretch the fabric.

2. A mounting system according to claim 1 in which the bolt-retaining means is a nut fixed to the first hole and in which the thread-defining means is said nut.

3. A mounting system according to claim 2 in which an end of the bolt engages a bottom of said second hole.

4. A mounting system according to claim 2 including a spring means yieldably interengaging the bolt and bottom of the second hole.

5. A mounting system according to claim 1 in which the thread-defining means are threads within the means defining the second hole.

6. A mounting system according to claim 5 in which the bolt engages the thread-defining means and does not engage the bottom of said first hole.

7. A mounting system according to claim 5 in which the thread-defining means comprises an internally-threaded tube, keyed to slide linearly within the second hole, and which additionally comprises a spring means positioned at the bottom of the second hole for yieldably interengaging the bottom of the second hole and an end of said internally-threaded tube.

8. An acoustic fabric-mounting system comprising:

a first elongated member and means for affixing said member to a wall surface;

a second elongated member spaced apart from said first member;

a fabric sheet connected to and extending between the first and second members;

means defining a first hole through the second member;

a third member, including means defining a second hole of a predetermined depth aligned with the first hole, and means for mounting the third member to the wall;

a shaft extending through the first hole into the second hole;

means for retaining the shaft in the first hole; and spring means yieldably interengaging the shaft and said means defining the second hole.

9. An acoustic fabric-mounting system comprising:

a wall;

a first frame member and means for affixing said member to a wall;

a second frame member spaced apart from said first member;

a fabric sheet connected to and extending between the first and second members;

an anchor member affixed to the wall; and tensioning means coupling the anchor member to the second elongated member for spreading the frame members apart.

10. A mounting system according to claim 9 in which the anchor member is affixed to the wall between the two elongated members and in which the tensioning means pushes against the anchor member and the second elongated member.

11. A method for mounting a flexible sheet on a frame including two spaced-apart members, comprising:

mounting a first one of said members fixedly on a wall;

connecting a first margin of the flexible sheet to the first member;

connecting a second margin of the sheet to the second member;

mounting an anchor on the wall at a position in between the two members;

providing expansion means interengaging the anchor and the second member for translationally positioning the second member relative to the first member; and operating said expansion means to apply a force against the second member away from the first member to tension the fabric.

12. A method according to claim 11 including slidably mounting the second member on the wall, and stretching the sheet between surfaces of the first and second members at a fixed distance from the wall, whereby a torsion is generated in the first and second members and securing the second member against the torsion caused by the sheet.

13. A method according to claim 12 including connecting the second member to the wall with a transversely slidable bracket at a location spaced apart from the expansion means.

* * * * *

UNITED STATES PATENT AND TRADEMARK OFFICE

CERTIFICATE OF CORRECTION

PATENT NO. : 4,574,538

DATED : March 11, 1986

INVENTOR(S) : Michael J. Grant

It is certified that error appears in the above-identified patent and that said Letters Patent is hereby corrected as shown below:

Column 2, line 27, "a a" should be --a--;

Column 5, line 2, "members" should be --member--;

Column 6, line 20, "horizontal" should be --vertical--;

Column 7, line 40, "36 of" should be --36 and--.

Signed and Sealed this

*Eighth* Day of *July 1986*

[SEAL]

*Attest:*

DONALD J. QUIGG

*Attesting Officer*

*Commissioner of Patents and Trademarks*